United States Patent [19]

Hashimoto et al.

[11] Patent Number: 4,924,490

[45] Date of Patent: May 8, 1990

[54] X-RAY MIRROR AND PRODUCTION THEREOF

[75] Inventors: Yoichi Hashimoto; Masami Inoue, both of Amagasaki, Japan

[73] Assignee: Mitsubishi Denki Kabushiki Kaisha, Tokyo, Japan

[21] Appl. No.: 300,949

[22] Filed: Jan. 24, 1989

[30] Foreign Application Priority Data

Feb. 9, 1988 [JP] Japan ..... 63-28360

[51] Int. Cl.[5] ..... G21K 1/00

[52] U.S. Cl. ..... 378/145; 378/84; 378/70

[58] Field of Search ..... 378/145, 70, 84

[56] References Cited

U.S. PATENT DOCUMENTS 4,693,933 9/1987 Keem et al. ..... 378/84

*Primary Examiner*—Craig E. Church

*Attorney, Agent, or Firm*—Oblon, Spivak, McClelland, Mair & Neustadt

[57] ABSTRACT

An X-ray mirror having its layer structure in the sequence of: a substrate having the surface roughness ($R_{max}$) of 1,000 Å or below; an intermediate layer of high molecular weight material formed on this substrate and having a surface roughness ($R_{max}$) of 100 Å or below; and a thin film formed on this intermediate layer, the X-ray mirror being produced by the process steps of: providing a substrate having a surface roughness ($R_{max}$) of 1,000 Å or below; forming on this substrate an intermediate layer of a high molecular weight material by spin-coating with a surface roughness ($R_{max}$) of 100 Å or below; and finally forming a thin film on this intermediate layer.

6 Claims, 4 Drawing Sheets

(a)

(b)

X-RAY MIRROR AND PRODUCTION THEREOF

BACKGROUND OF THE INVENTION

1. Field of the Invention

This invention relates to a structure of an X-ray mirror to be used for X-ray telescopes, X-ray microscopes, X-ray machining devices, and so on, and also it is concerned with a method for producing such X-ray mirror.

2. Discussion of Background

Conventionally, X-ray mirrors have been manufactured by the direct a vapor-deposition of a surface-smoothing thin film onto a substrate obtained from a material such as float glass, silicon wafer, polished glass, and so forth which can be machined to have very high surface smoothness (e.g., surface roughness [$R_{max}$] of 10 Å) by the method of ion-beam sputtering, electronbeam deposition, laser-beam deposition, and so on. In the following, explanations will be given as to production of the X-ray mirror by the electron beam deposition method, in reference to "0 plus E", No. 88 (March 1987), pp. 67–73, by Yamashita as well as FIG. 5 of the accompanying drawing to the present application.

In the drawing, a reference numeral 1 designates a substrate, a numeral 4 refers to a crucible, a reference numeral 5 denotes electron beam for heating, a reference numeral 6 represents a shutter, a reference numeral 7 designates a thermo-couple, a numeral 8 refers to a film gauge, and a reference numeral 9 designates a vacuum container. Arrow marks indicate exit directions of exhaust gas. In the manufacture of the X-ray mirror by means of a device having such construction as mentioned above, the substrate to be used is chosen from float glass, silicon wafer, and so on, which can be rendered to have extremely smooth surface by the high precision machining such as float-polishing, etc. The material chosen as the substrate 1 is placed in the vacuum container 9, followed by evacuation of its interior. Thereafter, a deposition material such as, for example, Ni, Mo, Si, C, etc., which has been placed in the crucible 4, is heated by the heating electron beam 5 to a temperature, at which it attains a vapor pressure for the effective vapor-deposition. It is also possible that, by association of the shutter 6 with this heating electron beam source 5, the deposited film in a single or multi-layered structure may be distinctly formed. The temperature of the substrate can be monitored by the thermo-couple 7, and the film thickness can be checked by the film gauge 8.

Since the conventional X-ray mirror has been manufactured as mentioned above, and since the wavelength, with which the mirror is used, is within the X-ray range of several hundreds angstroms or shorter, it becomes essentially required that the film surface on the mirror should possess high smoothness (e.g., several tens of angstroms or below in terms of its surface roughness). On account of this, it was necessary to finish the surface of the coated film on the mirror to have high smoothness by means of a special machining method such as the float-polishing, elastic emission machining (EEM), and so on, the finishing methods of which were not so common. There was a further problem such that, while these machining methods were effective on those limited kinds of materials such as glass, silicon wafer, molybdenum, etc., they were not so effective on those fragile materials such as ceramics, etc., porous materials such as sintered bodies, etc., tough materials such as Fe, Al, Cu, etc., and other materials, with the result that arbitrariness in the selection of the material was extremely limited.

The nature of the problem inherent in the conventional methods can be said to have resided in the structure of the mirror per se, wherein the coating film is directly formed on the substrate.

SUMMARY OF THE INVENTION

The present invention has been made with a view to solving the above-mentioned points of problem, and aims at providing an improved X-ray mirror and an improved mathod of its production, with which it becomes possible to widen the selective range of the materials to be used as the substrate, and to manufacture the same without employing any special machining method.

According to the present invention, in one aspect of it, there is provide an X-ray mirror which comprises, in combination: a substrate having the surface roughness of 1,000 Å or below; and intermediate layer of high molecular weight material formed on said substrate and having a surface roughness of 100 Å or below; and a thin film formed on said intermediate layer.

According to the present invention, in another aspect of it, there is provided a method for producing an X-ray mirror which comprises steps of: providing a substrate having a surface roughness of 1,000 Å or below; forming on said substrate an intermediate layer of a high molecular weight material by spin-coating to have a surface roughness of 100 Å or below; and finally forming a thin film on said intermediate layer.

The foregoing object, other objects as well as the specific methods for producing the X-ray mirror according to the present invention will become more apparent and understandable from the following detailed description thereof, when read in conjunction with the accompanying drawing.

DETAILED DESCRIPTION OF THE PREFERRED EMBODIMENTS

In the following, a preferred embodiment of the X-ray mirror and the method of its production according to the present invention will be described in reference to the accompanying drawing.

Figure 1:
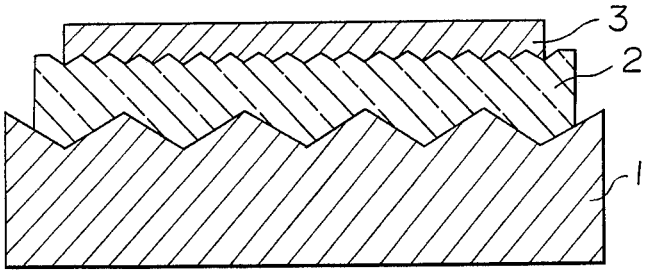
FIG. 1 is a schematic cross-section showing the X-ray mirror according to one embodiment of the present invention.
Figure 2:
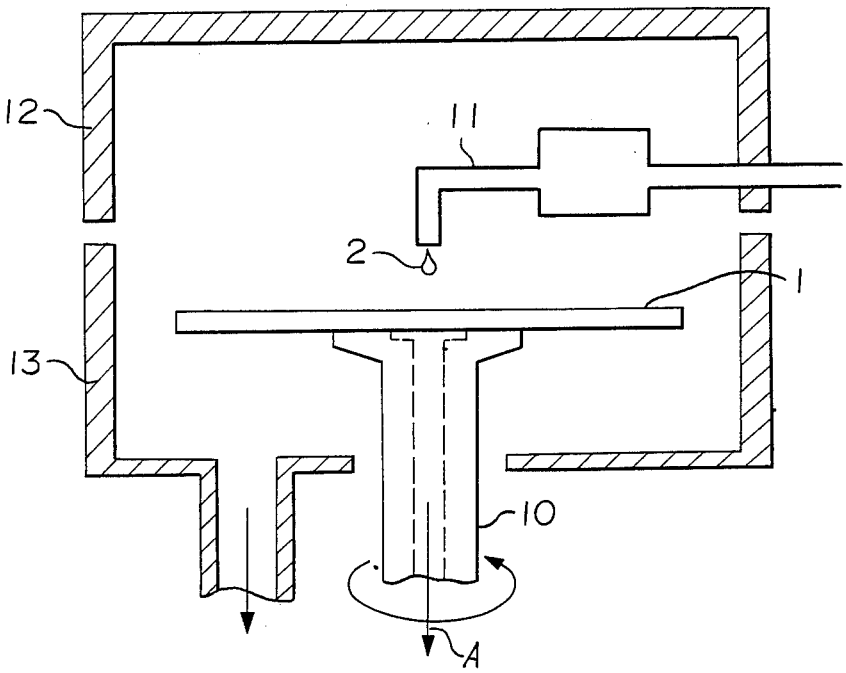
FIG. 2 is a schematic cross-section showing the construction of the spin-coating device to be used for producing the X-ray mirror according to one embodiment of the present invention.

FIG. 1 illustrates schematically in cross-section a structure of the X-ray, mirror according to the present invention, in which a reference numeral 1 designates a substrate, a numeral 2 refers to an intermediate layer made up of a high molecular weight material, and a numeral 3 refers to a thin film FIG. 2 is a schematic structural diagram showing in cross-section a spin-coating device to be used for forming the intermediate layer 2 composed of high molecular weight material as shown in FIG. 1. In the drawing, a reference numeral 10 designates a specimen table, a numeral 11 refers to a nozzle, a numeral 12 denotes an upper cover, and a numeral 13 refers to a spinner cup.

First of all, the substrate 1 in FIG. 1 can be machined by a lathe, a grinder an abrasive machine, etc. which are commonly used. For instance, when the copper substrate is machined by the lathe, such machining is carried out under the conditions of a machine revolution of 1,000 rpm, a depth of cut of 5 μm, and a feed per revolution of 5 μm/rev., using a diamond bite, whereby the surface roughness ($R_{max}$) of 400 Å or around that figure can be attained easily.

In the next place, the intermediate layer 2 composed of a high molecular weight material can be formed by means of the spin-coating device as shown in FIG. 2. The spin-coating method is widely used at present for coating of the photo-resist in the process of producing semiconductor elements. This process will be explained in the following. The substrate 1 which has been finished to have its surface roughness ($R_{max}$) of a few hundreds angstroms (Å) is mounted on the specimen table 10 in the spin-coating device of FIG. 2, which is then sucked under the vacuum (arrow A) so as to be fixed on the table. Subsequently, a high molecular weight material 2 is dropped at a certain definite quantity through a nozzle 11 of a feed system. Thereafter, the substrate is spinned at a revolution of several thousands of revolution per minute to form a high polymer coating on it. In this case, the major part of the high molecular weight material as dropped splashes from the surface of the substrate. In order therefore not to cause the splashes material to adhere again onto the specimen, various device are made on the internal structure of the spinner cup 3. Needless to say, when the coating film is to be formed on the substrate by various vapor-deposition methods, it is done by following elevations and depressions on the surface of the substrate. In the method as used in this example, however, since the high molecular weight material is in the liquid state, it is least affected by such elevations and depressions on the substrate surface, with the result that the surface roughness ($R_{max}$) of the high polymer film as coated on the substrate is approximately 10 Å.

Figure 3:
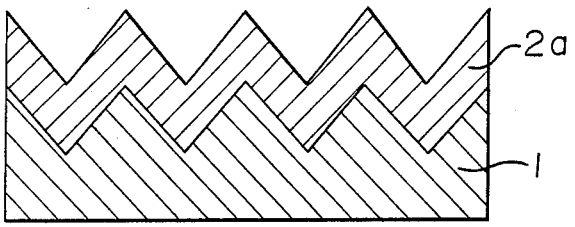
FIGS. 3(*a*) and 3(*b*) are respectively schematic cross-sections illustrating how the surface roughness of the substrate affect the top coating deposited on it with different methods of coating.
Figure 3:
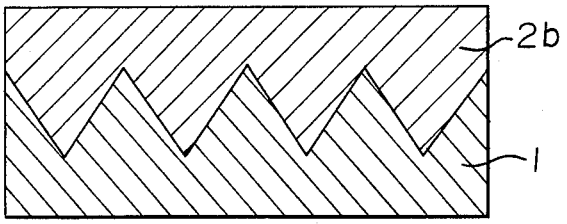

FIGS. 3(*a*) and 3(*b*) are schematic cross-sectional views respectively showing a case wherein the thin film 2*a* is formed on the substrate by a common vapor-deposition method, and a case wherein the high polymer film 2*b* is formed on the substrate by the spin-coating method. From these two illustrations, it is seen that the high polymer film 2*b* has a smooth surface without its being affectd by the surface roughness of the substrate. In addition, by the revolution of the substrate for about 10 seconds, the high polymer film deposited on the substrate is accelerated for its drying. As for the film thickness of the high molecular weight meterial, it can be controlled in a range of from 0.3 to 2.1 μm in the case of the photo-resist made up, for example, of novolac resin as the principal constituent, under the coating conditions of the revolution of the spin-coating device of 2,000 to 800 rpm, by use of the resin solution with its viscosity having been adjusted in a range of from 5 to 31 cst (centi-stokes). By the above-mentioned process steps, it is possible to form the intermediate layer having its surface roughness of several tends of angstroms as required of the X ray mirror.

Figure 4:
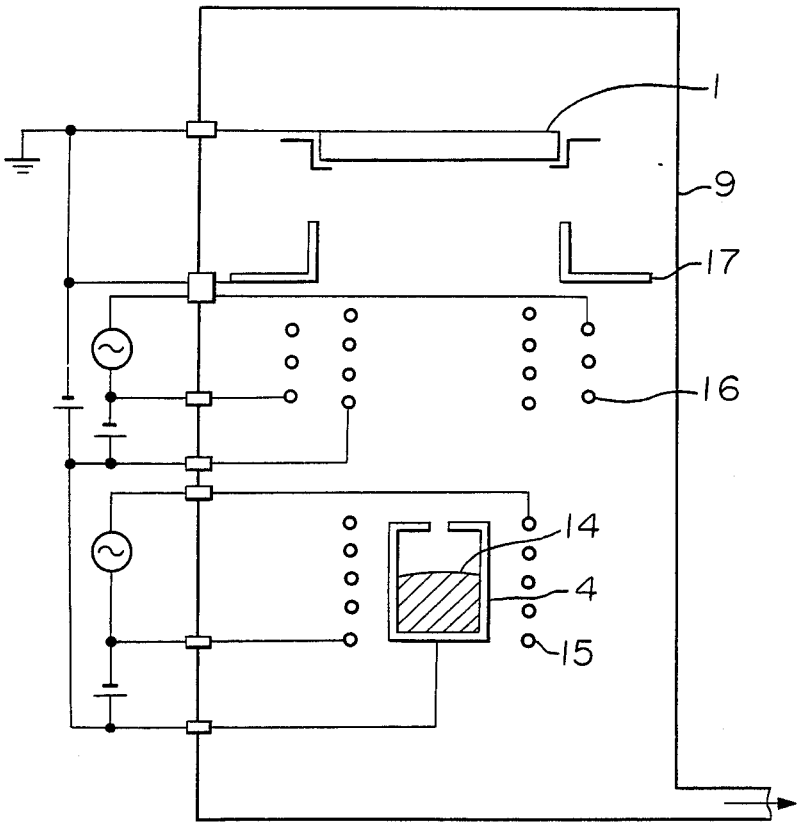
FIG. 4 is a schematic structural diagram showing a cluster ion-beam deposition device to be used or the production of the X-ray mirror according to one embodiment of the present invention.
Figure 5:
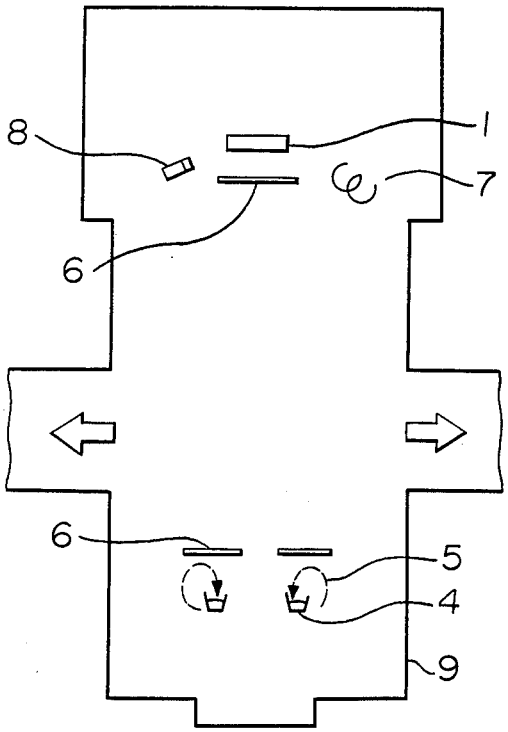
FIG. 5 is a schematic structural diagram showing a conventional deposition device to be used for the production of the X-ray mirror.

It may be worthy of note here that, for the third process step, various vapor deposition methods, which have so far been employed, can be used exactly as they are. As an example, explanations will be given in the following, in reference to FIG. 4, as to a case wherein gold is vapor deposited on the substrate by means of the cluster ion beam deposition. In the drawing, a reference numeral 1 designates a substrate, a numeral 4 refers to a crucible, a numeral 9 denotes a vacuum container, a reference numeral 14 represents a vapor-deposition material, a numeral 15 refers to a crucible heating device a reference numeral 16 designates an electron beam radiation source, and a numeral 17 refers to accelerating electrodes. The process steps for the vapor-deposition are as follows first of all, the interior of the vacuum container 9 is evacuated, after which the crucible 4 and gold as the vapor-deposition material 14 are heated. The heating temperature is maintained at about 1,600° C. in the case of gold (Au). In this state of heating, cluster of gold blows out through a small orifice formed on top of the crucible 4. A part of the cluster as blown out of the crucible is ionized by the electron shower generated from the electron beam radiation source 16. The ionized cluster of gold is imparted with kinetic energy by the accelerating electrodes 17 (1 to 10 V), while the remaining part of the cluster which has not been ionized participates in the film formation along with the neutral cluster. In the following, there will be indicated the characteristics of a thin film of gold formed on the substrate of polyimide to a film thickness of 500 Å by the cluster ion beam deposition method under the deposition conditions of: the degree of vacuum during the deposition of $1\times10^{-6}$ Torr the accelerating voltage of 3 KV, the ion current density of 1 μA/cm$^2$, and the temperature of the substrate of 80° C., the characteristics of which have been found out by measuring the scattering angle distribution of beam reflection of the X-ray having the wavelength of 8 Å. The results of the measurement indicate excellent values of: the surface roughness of 4.7 Å, a ratio of the scattered component of beam to the total reflection component of 1.8%, and the reflectivity of 91% with respect to the theoretical value. These values are quite satisfactory to meet the specifications of the X-ray telescope, and others, when the X-ray mirror of the present invention is intended for its application to such instruments.

As has so far been described in the foregoing, the present invention is of such a construction that the intermediate layer of a high molecular weight material having its surface roughness ($R_{max}$) of 100 Å or below is formed on the substrate having its surface roughness ($R_{max}$) of 1,000 Å or below, on which intermediate layer there is formed the top coating thin film. With this layer structure, the elevations and depressions on the surface of the substrate do not give influence on the surface roughness of the top coating thin film, so that a wider range of materials such as ceramics, ferrous materials, and others, which have heretofore been difficult to machine for their high surface smoothness, now become able to be used effectively as the substrate.

Further, since the intermediate layer can be formed by the spin-coating method, there may be exhibited other resulting effect such that the X-ray mirror can be produced without use of the special machining method such as the float-polishing which has so far been employed.

Although the present invention has been described in detail in the foregoing with reference to a preferred embodiment thereof, it should be understood that the invention is not limited to this embodiment alone, but any changes and modifications may be made by those persons skilled in the art without departing from the spirit and scope of the invention as recited in the appended claims.

What is claimed is:

1. An X-ray mirror which comprises, in combination: a substrate having the surface roughness of 1,000 Å or below; an intermediate layer of high molecular weight organic polymer material formed on said substrate and having a surface roughness of 100 Å or below; and a thin film formed on said intermediate layer.

2. An X ray mirror according to claim 1, wherein said substrate is of copper (Cu).

3. An X-ray mirror according to claim 2, wherein said high molecular weight material is photo-resist made up of phenolic novolac resin as the principal constituent.

4. An X-ray mirror according to claim 3, wherein said thin film is of gold (Au).

5. An X-ray mirror according to claim 1, wherein said substrate is of ceramic.

6. An X-ray mirror according to claim 1, wherein said substrate is of ferrous material.

* * * * *